United States Patent [19]

Künstle et al.

[11] 4,095,959

[45] Jun. 20, 1978

[54] COAL GASIFICATION APPARATUS

[75] Inventors: Konrad Künstle, Rottenbach; Christian Koch; Kurt Reiter, both of Erlangen, all of Germany

[73] Assignee: Kraftwerk Union Aktiengesellschaft, Mulheim, Germany

[21] Appl. No.: 768,498

[22] Filed: Feb. 14, 1977

[30] Foreign Application Priority Data

Mar. 6, 1976 Germany ..... 2609320

[51] Int. Cl.[2] ..... C10J 3/20

[52] U.S. Cl. ..... 48/73; 48/63; 48/77

[58] Field of Search ..... 48/206, 210, 63, 64, 48/73, 77; 210/67

[56] References Cited

U.S. PATENT DOCUMENTS

| | | | |
|---|---|---|---|
| 2,633,416 | 3/1953 | Gormowski et al. | 48/206 |
| 2,776,879 | 1/1957 | Gumz | 48/63 |
| 3,347,647 | 10/1967 | Feldkirchner et al. | 48/206 |
| 3,746,522 | 7/1973 | Donatl | 48/210 |
| 3,775,071 | 11/1973 | Hoffert et al. | 48/206 |
| 3,782,913 | 1/1974 | Donatl | 48/210 |
| 3,836,461 | 9/1974 | Whitehead et al. | 210/67 |
| 3,971,639 | 7/1976 | Matthews | 48/206 |
| 3,973,733 | 8/1976 | Switzer | 241/1 |

FOREIGN PATENT DOCUMENTS

| | | | |
|---|---|---|---|
| 93,543 | 1918 | Switzerland | 48/210 |

OTHER PUBLICATIONS

"Water Treatment," Power Special Report, Dec. 1958, pp. 90–93.

*Primary Examiner*—S. Leon Bashore
*Assistant Examiner*—Peter F. Kratz
*Attorney, Agent, or Firm*—Herbert L. Lerner

[57] ABSTRACT

Coal gasification apparatus having a hydrogenation gasifier chamber for gasifying a portion of coal charge and a steam gasifier vessel for gasifying unconverted coal from the hydrogenation chamber with the chamber disposed above the vessel and a pressure lock interposed between the outlet of the chamber and the inlet of the vessel to permit unconverted coal to flow into the vessel and prevent gas generated therein from passing into the chamber. An oxygen inlet is provided at the lower end of the vessel for residual-oxidation of remaining coal. A heat exchanger is provided for heat exchange between hot gas leaving vessel and incoming steam. The chamber may be preceded by a steam-heated heating tank for preheating the coal under pressure and then suddenly decompressing the coal.

6 Claims, 3 Drawing Figures

COAL GASIFICATION APPARATUS

BACKGROUND OF THE INVENTION

1. Field of the Invention

This invention relates to gasification of coal and, more particularly, refers to new and improved coal gasification apparatus in which coal is subjected to hydrogenation gasification and steam gasification.

2. Description of the Prior Art

Multistage coal gasification apparatus, in which methane or other hydrocarbon-containing gases or liquids are produced from coal is described in the book "Rohstoffwirtschaft International", vol. 4, "Kohlevergasung" (Coal Gasification), 1976, Verlag Glueckauf GmbH, Essen, pages 175 to 185. In this process for the gasification of coal, hydrogenating gasification and steam gasification are performed in combination. The hydrogen generated in the steam gasification is used, together with the steam, for the hydrogenation gasification in a higher stage.

SUMMARY OF THE INVENTION

It is an object of the present invention to provide coal gasification apparatus which permits substantially complete conversion of the coal, leaving ash as residue. Another object of the invention is to provide apparatus in which medium-pressure steam at about 20 to 100 bar pressure can be used as the reaction steam of the steam gasification.

A further object of the invention is to provide apparatus which permits hydrogenation gasification without a turbulance chamber. A still further object of the present invention is to provide means for converting the residue from a water treatment plant and the left-over ash to material usable as building material.

With the foregoing and other objects in view, there is provided in accordance with the invention, coal gasification apparatus having a hydrogenation gasifier chamber for gasifying a portion of coal fed therein in the presence of hydrogen, a coal inlet in the hydrogenation gasifier chamber for the introduction of the coal in the chamber, a hydrogen inlet in the hydrogenation gasifier chamber for the introduction of hydrogen in the chamber, a residue discharge outlet in the hydrogenation gasifier chamber for the discharge of unconverted coal containing ash from the chamber, a steam gasifier vessel for gasifying the unconverted coal in the presence of steam, an unconverted coal inlet in the steam gasifier vessel for the introduction of the unconverted coal in the vessel, a steam inlet in the steam gasifier vessel for the introduction of steam in the vessel, an ash discharge outlet in the steam gasifier vessel for the discharge of the ash from the vessel, the combination therewith of disposing the residue discharge outlet above the unconverted coal inlet and interposing a pressure lock between the outlet and the inlet to permit unconverted coal to flow into the steam gasifier vessel and preventing gas generating in the vessel from passing into the hydrogenation gasifier chamber, an oxygen inlet in the steam gasifier vessel for the introduction of oxygen to effect partial combustion of the unconverted coal, a gas release outlet in the steam gasifier vessel for the release of gas from the vessel, and a heat exchanger through which the gas from the gas release outlet passes in heat exchange with steam prior to entering the steam inlet.

In one embodiment of the invention, the hydrogenation gasifier is preceded by a steam-heated heating tank for preheating the coal under pressure by direct contact with steam and wherein the heating tank has a pressure lock for discharging the steam-heated coal under high pressure in the tank to a zone of reduced pressure to cause sudden decompression of the coal and the water contained therein.

In a preferred embodiment of the invention the steam gasifier vessel has the steam inlet in the steam gasifier vessel separate from the oxygen inlet and the steam inlet for the steam disposed above the oxygen inlet and in the lower part of the steam gasifier vessel wherein residual-oxidation of residual coal takes place in the lower part of the vessel.

BRIEF DESCRIPTION OF THE DRAWINGS

Other features which are considered as characteristic for the invention are set forth in the appended claims.

Although the invention is illustrated and described herein as embodied in coal gasification apparatus, it is nevertheless not intended to be limited to the details shown, since various modifications may be made therein without departing from the spirit of the invention and within the scope and range of equivalents of the claims.

Figure 1:
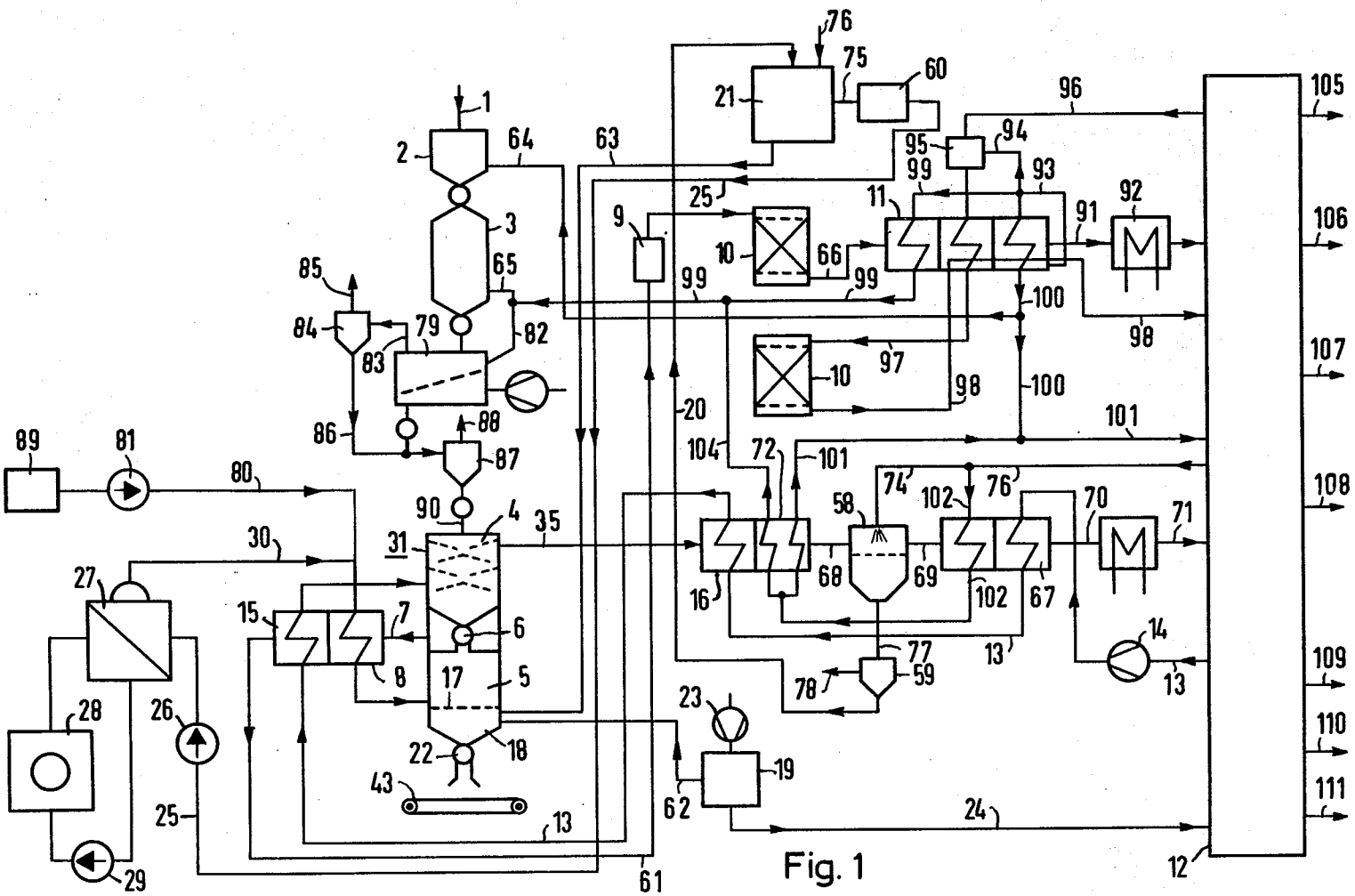
Figure 2:
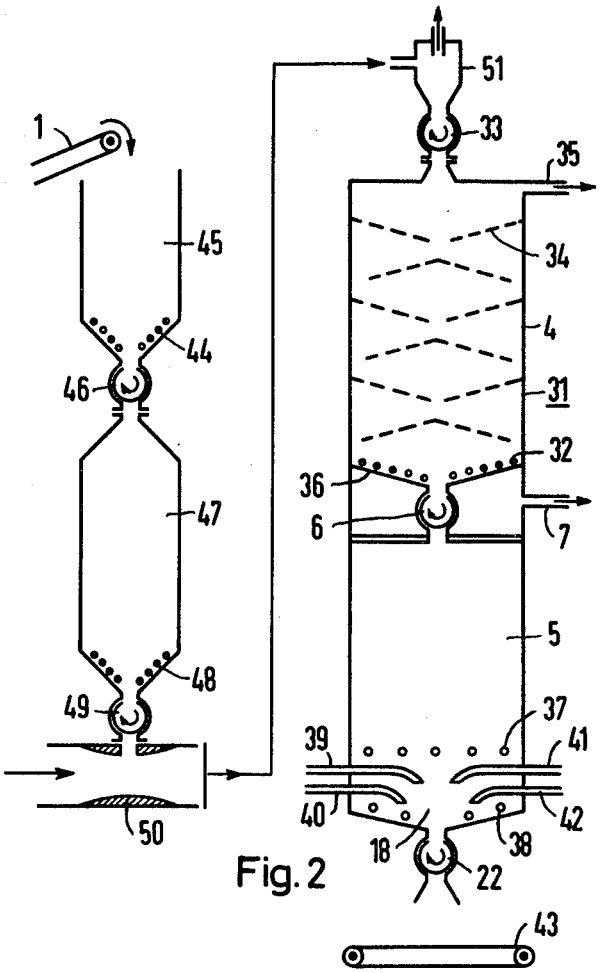
Figure 3:
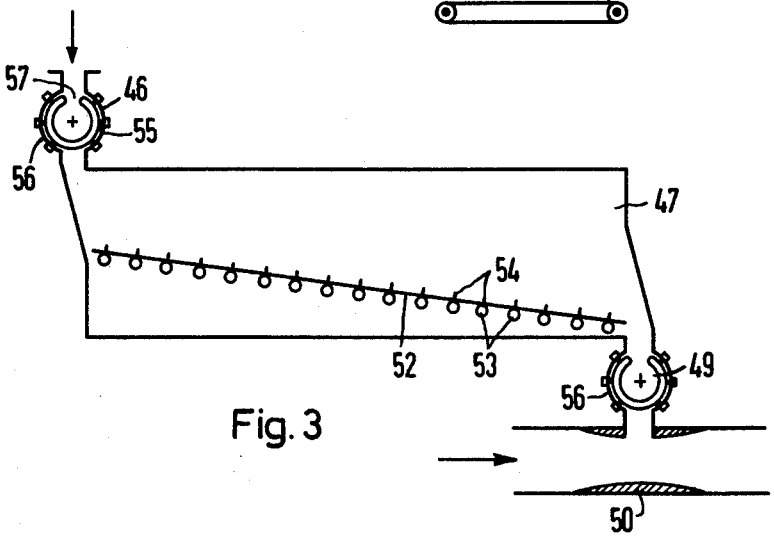

The invention, however, together with additional objects and advantages thereof will be best understood from the following description when read in connection with the accompanying drawings, in which:

FIG. 1 diagrammatically illustrates the apparatus for carrying out the present invention; and FIG. 2 diagrammatically illustrates a steam-heated heating tank preceding a hydrogenation gasifier chamber; and FIG. 3 illustrates another form of steam-heated heating tank.

DETAILED DESCRIPTION OF THE INVENTION

In the coal gasification apparatus of the present invention, a hydrogenation gasifier is employed for gasifying the volatile and readily reactive components of the coal with hydrogen generated in a following steam gasifier. Oxygen is supplied to the steam gasifier in addition to the steam. Between the hydrogenation gasifier and the steam gasifier is provided a pressure lock which prevents the passage of the gas generated in the steam gasifier into the hydrogenation gasifier. A gas line leads from the steam gasifier via a heat exchanger with connections in the exchanger for the second heat-exchanging medium inserted into the steam line leading to the steam gasifier.

Referring to FIG. 1, the raw coal is transferred via a conveyor belt 1 into a predrier 2 and from there into a postdrier 3, and then into a hydrogenation gasifier 4. Predrier 2 may be a small vessel into which the raw coal containing moisture is fed. Drying of the raw coal and some preheating of the coal may be accomplished by introducing a hot gas, preferably a waste gas of the process into predrier 2, as for example via line 64, in direct contact with the wet raw coal thereby at least partially drying and preheating the coal. The gas containing moisture is discharged through a suitable outlet from predrier 2. The postdrier 3 may be designed as a conventional fluidized-bed drier wherein the particles of coal are kept in turbulent or fluidized state by means of a hot gas entering, for example, through line 65. Further drying and preheating of the coal is effected in postdrier 3. Particularly advantageous embodiments without fluidized bed are given in FIGS. 2 and 3. Between the hydrogenation gasifier 4 and the following steam gasifier 5, there is a pressure lock 6, which separates the hydrogenation gasifier 4 and the steam gasifier 5 in a substantially gas-tight manner, i.e., prevents gas generated in steam gasifier 5 from passing upward into hydrogenation gasifier, but allows coal to get from the hydrogenation gasifier 4 into the steam gasifier 5. An embodiment of such a lock is shown in detail in FIG. 3.

A gas line 7 leading from the steam gasifier 5 is connected to a heat exchanger 8. A gas mixture of $CH_4$, $H_2$, $CO_2$, CO, and $H_2$ at a temperature of about 800° C leaving the steam gasifier 5 flows through heat exchanger 8 in heat exchange with a cooler medium and cooled to a lower temperature. From the heat exchanger 8, this gas mixture passes through a second heat exchanger 15 and the thus further cooled gas mixture is directed via an injection cooler 9, i.e., cooling by injecting a coolant, to a converting device 10. In the converting device 10, the gas mixture is processed in known manner. Hydrogen and carbon dioxide are obtained in accordance with the following formula:

$$7\,CO + 3\,H_2 + H_2O \rightleftarrows 10\,H_2 + 7\,CO_2 (-288.8\ kJ/7\ mol\ CO_2).$$

The gas mixture or reaction products obtained in this manner discharged from converting device 10 flow through line 66 to heat exchanger 11 where the gas mixture is cooled. The $CO_2$ and $H_2S$ contained in the gas mixture are separated in a gas scrubber 12 which may employ conventional mediums such as alkaline material or solvents to remove $CO_2$ and $H_2S$. After separation of the $CO_2$ and $H_2S$ from the gas, the remaining $H_2$ and $CH_4$ flows through gas line 13 to compressor 14 where it is compressed and forced through heat exchangers 67, 16 and 15, which latter is connected parallel to the heat exchanger 8, for heating the gas containing $H_2$ and $CH_4$, and then introducing the heated gas into the hydrogenation gasifier 4. There, the known reaction takes place between the fed-in hydrogen and the components of the coal in accordance with the following formula:

$$29\,C + CO + CH_4 + 57\,H_2 + H_2O \rightarrow 30\,CH_4 + CO_2 (-85\ kJ/mol\ CH_4).$$

The raw gas produced in this process, consisting substantially of methane, is discharged from reaction tank 31 through line 35 to heat exchanger 16 where it preheats the $H_2$ and $CH_4$ gas flowing through line 13 and then through heat exchanger 72 where it serves for generating the steam required for preheating the raw coal. Subsequently the $CH_4$ can be processed or converted into liquid fuels.

While the reaction in the hydrogenation gasifier is exothermic, so that the reaction temperature does not drop, there likewise takes place an exothermic reaction in the steam gasifier according to the equation:

$$39\,C + 8O_2 + 59\,H_2O \rightarrow CH_4 + CO + 57\,H_2 + 37\,CO_2 (-18\ kJ/mol\ H_2).$$

The steam gasifier 5 has above its lower portion a grate or divider or connection 17, which permits residual coal to drop down through the grate to a residual-oxidation device 18 which is the lower portion of gasifier 5, and permits gas to pass up through the grate. The coal degasified in the steam gasifier 5 still contains a residue of about 5% carbon plus, of course, non-combustible ash. Oxygen from air separation device 19 is fed through line 62 to this coal/ash mixture in the residue-oxidizing device 18 to substantially complete burning of the residual carbon and generate heat used in steam gasifier 5. Residue from a water treatment plant 21 transferred via line 63 is mixed with the coal burned under the influence of oxygen in the residue-oxidizing device 18 and, together with the rest of the ash, forms a porous waste material which is suitable for building purposes. The porous waste material is discharged from residue-oxidation via pressure lock 22 onto conveyor belt 43. Air is supplied by a compressor 23 to air dissociation or separation plant 19 which may be any conventional means for separating oxygen from air. The nitrogen remaining after extraction of oxygen from the air discharges from air separation plant 19 through line 24.

As previously mentioned steam is required in steam gasifier 5. To provide this steam, purified water is needed. Purification of water is a well known procedure and usually involves removing contaminents or wastes in water. Water, such as natural water from an external source, is introduced into the system through line 76 to feed water treatment plant 21 wherein organisms and suspended matter are removed by distillation. The water then flows through line 75 into water treatment plant 60 where the water is softened by treatment with an ion-exchanger.

The water treatment plant 21 also receives water from the gas scrubber 58 where water entering line 74 is sprayed on the incoming gas entering through line 68, thus condensing water vapor contained in the gas. The aqueous condensate which usually contains lighter oily constituents floating on the water layer is discharged through line 77 into separator 59 where the oily layer is drawn off through line 78. The water from separator 59 is sent through line 20 to water treatment plant 21. The treated water from plant 60 flows through line 25 and is forced by feed pump 26, to the steam generator 27 of a light-water reactor 28, the cooling water circulation of which is maintained by a circulating pump 29. The steam produced in the steam generator 27, which may simultaneously also generate sufficient steam for operating a turbine, is released through line 30 at a temperature of about 300° C and conducted through the heat exchanger 8 to the steam gasifier 5. In the heat exchanger 8, the steam is superheated by indirect heat exchange with hot gas leaving gasifier 5 through line 7 to a temperature of about 600° to 800° C, so that a sufficiently high temperature is available for the endothermic reaction in the steam gasification. Due to the fact that steam having a high temperature can be fed into the steam gasifier even through process steam of lower temperature is used, relatively little oxygen is consumed in the following residual-oxidation device 18. Separating the steam gasifier and the residual-oxidation device makes it possible, in addition, to burn at the same time only that portion of carbon which is not gasified in the steam gasification.

The dried coal from postdrier 3 passes into chamber 79 catalyst is forced by pump 81 from tank 89 through line 80 into steam line 30. The coal may be kept in heated condition by the introduction of steam through line 82. Excess gas and steam are released from the top of chamber 79 through line 83 into separator 84 which separates the gas from the entrained solid particles. The gas is released through line 85 and the separated solid particles discharged through line 86 together with coal discharged from chamber 79 enter feeder 87. Gas separating in feeder 87 is released through line 88 and the coal passes through line 90 into hydrogenation gasifier 4.

The gases leaving converting device 10 through line 66 passes through heat exchanger 11, then through line 91 and cooler 92 where it is further cooled, and into column 12 for separation of the gaseous constituents. A portion of the gases diverted through lines 93 and 94 together with $H_2$ from line 96 are comingled at 95 and then sent through line 97 through heat exchanger 11 and with the reaction products flowing back through heat exchanger 11 via line 98 into column 12. A portion of the gas from line 93 may be directed through line 99, thence through line 65 and/or line 82. Another portion of the gas may be diverted via line 100 through heat exchanger 11 and thence through line 64 into predrier 2. A portion of the gas may flow from line 100 through line 101 into scrubber 12. Water from line 74 flows in part through line 102 and heat exchanger 67 where it is preheated and then through heat exchanger 72 where the steam is superheated with a portion of the preheated steam passing through lines 104 and 99 through line 65 into postdrier 3 or through line 82 into chamber 79. A part of the steam may be sent through line 101 for use in separation of the gaseous constituents. The lines 105, 106, 107, 108, 109, 110 and 111 designate respectively the products $H_2$, $N_2$, $CH_4$, CO, $CO_2$, $H_2S$ and $H_2O$ which may be separated.

In FIG. 2, a particularly advantageous arrangement of the three-stage gasification is shown, in which the hydrogenation gasification can be carried out without a fluidized bed and in which a common tank is provided for all three gasification stages. The hydrogenation gasification takes place in the upper part of the reaction tank 31. The hydrogen is fed-in through nozzles 32 and the treated coal passes through a pressure lock 33 into the upper part of the reaction tank 31 and slowly slides down there over inclined intermediate baffles 34. The methane produced is taken off from line 35. The upper part of the reaction tank 31 is separated from the lower part by a partition 36. The partition 36 has at the center an opening, into which a pressure lock 6 is built. The gases produced are discharged from the gas space of the lower part of the reaction tank 31 through the line 7 and the heat exchanger 8 to the converting device 10. The lower part of the reaction tank 31 constitutes the steam gasifier 5 and is separated downward from the bottom part of the reaction tank 31 by steam nozzles 37. The space below the steam nozzles 37 serves as the residue-oxidation device 18. Immediately above the bottom of the reaction tank 31, the oxygen nozzles 38 enter, which serve for supplying the oxygen generated in the air dissociation equipment 19. The line 63 for the residue or spent treating agent from the water treatment plant 21 has several sub-lines 39 to 42, which open into the reaction tank 31 distributed over the circumference, so that the residue discharged there can mix with the hot ash. The pressure lock 22 is arranged below the reaction tank 31. Below this, a conveyor belt 43 is provided for carrying off the construction material.

The coal arriving via the conveyor belt 1 is preheated in a preheater 45 by steam which is fed-in via nozzles 44 so that a sufficient reaction speed can be obtained in the hydrogenation gasifier 4 of FIG. 2. Underneath the preheater 45, a pressure lock 46 is provided which separates the preheater 45, which is at atmospheric pressure, from the heating tank 47. The heating tank 47 also has steam inlet nozzles 48 which supply medium-pressure steam, which can be taken off, for example, likewise at the steam generator 27 in FIG. 1. In the heating tank 47, the coal is heated at a pressure of about 20 to 100 bar. The steam flowing around the coal and the high pressure prevent the water contained in the coal from evaporating, so that the water-containing coal can be heated to a temperature far above 100° C, for example, about 200° to 600° C. Below the heating tank 47, there is located another pressure lock 49, which is connected to an air line 50. In the pressure lock 49 the pressure surrounding the coal is suddenly reduced. This reduced pressure, together with the air stream in the air line 50, causes the water contained in the lumps of coal to evaporate rapidly and a multiplicity of fine canals open to the outside are formed in the lumps of coal. The coal treated in this manner has a very large surface, so that reaction, aided by catalysts, can be obtained in the hydrogenation gasifier 4 without the need for providing a fluidized-bed drier corresponding to the postdrier 3 in FIG. 1. Above the pressure lock 33, the coal-air mixture is separated in a charging stub 51.

A particularly advantageous embodiment for the heating tank 47 is shown in FIG. 3. The heating tank 47 shown here contains an inclined bottom 52. Underneath this bottom, steam pipes 53 are installed, which are equipped with nozzles 54. The coal will slide slowly down the inclined plane while the steam flows around it directly heating the coal. It may further be seen in FIG. 3 that the pressure locks 46 and 49 each enclose a lock receptacle 56 in the form of a hollow sphere, which is rotatably disposed and is provided with an opening 57. Spring-loaded sealing pins 55 are provided outside the lock receptacles 56 and prevent the passage of gas. By rotating a lock receptacle 56, the opening 57 contained in it is alternatingly connected to the space inside and outside the heating tank 47, so that the coal, under the force of gravity, can be transported into or out of the tank. All the other pressure locks described can be constructed in the same manner.

There are claimed:

1. In coal gasification apparatus having a hydrogenation gasifier chamber for gasifying a portion of coal fed therein in the presence of hydrogen, a coal inlet means in said hydrogenation gasifier chamber for the introduction of said coal into the upper portion of said chamber, said chamber containing intermediate baffles over which the coal slowly slides down a hydrogen inlet means in said hydrogenation gasifier chamber for the introduction of hydrogen in said chamber, a residue discharge outlet means in the bottom of said hydrogenation gasifier chamber for the discharge of unconverted coal containing ash from said chamber, a product gas outlet means near the top of said hydrogenation chamber for the release of gas produced therein, a steam gasifier vessel for gasifying said unconverted coal in the presence of steam, an unconverted coal inlet means in said steam gasifier vessel for the introduction of said unconverted coal in said vessel, a steam inlet means in said steam gasifier vessel for the introduction of steam in said vessel, an ash discharge outlet means in the bottom of said steam gasifier vessel for the discharge of said ash from said vessel, the combination therewith of disposing the hydrogenation gasifier chamber and the steam gasifier vessel in a common vertical tank with said residue discharge outlet means of the hydrogenation gasifier chamber above said unconverted coal inlet means of the steam gasifier vessel and interposing a partition with a central opening containing a pressure lock between said outlet and said inlet, said pressure lock having a rotating lock receptacle with an opening which is alternatingly connected to the space inside the hydrogenation chamber and the space inside the steam gasifyer vessel to permit unconverted coal to flow into the steam gasifier vessel and prevent gas generated in the vessel from passing into the hydrogenation gasifier chamber, an oxygen inlet means in said steam gasifier vessel for the introduction of oxygen to effect partial combustion of said unconverted coal, a gas release outlet means in said steam gasifier vessel for the release of gas from said vessel, and a first heat exchanger through which said gas from said gas release outlet means passes in heat exchange with steam prior to entering said steam inlet means and wherein said steam gasifier vessel has said steam inlet in said steam gasifier vessel separate from said oxygen inlet and said steam inlet separates the bottom of the common tank from the above steam gasifier vessel forming a residue-oxidation chamber wherein the oxygen inlet is located and wherein residual oxidation of residual coal takes place.

2. Coal gasification apparatus according to claim 1, including a second heat exchanger connected thereto through which said gas from the first heat exchanger passes in heat exchange with gas containing $H_2$ and $CH_4$ for introduction of said $H_2$ and $CH_4$ into said hydrogen inlet in said hydrogenation gasifier chamber prior to entering said hydrogen inlet.

3. Coal gasification apparatus according to claim 1, including a thermal water treatment plant for treating water to be converted to said steam with a softening agent and means for charging sludge from the water treatment plant into said lower part of said vessel wherein residual-oxidation takes place.

4. Coal gasification apparatus according to claim 1, wherein said hydrogenation gasifier is preceded by a steam-heated heating tank connected thereto for preheating the coal under presssure by direct contact with steam and wherein said heating tank has a pressure lock having a rotating lock receptacle with an opening which is alternatingly connected to the space inside the steam-heated heating tank, for discharging the steam-heated coal under high pressure in the tank to a zone of reduced pressure to cause sudden decompression of the coal and the water contained therein.

5. Coal gasification apparatus according to claim 1, including means for introducing catalysts to the reaction steam supplied to the steam gasification process.

6. Coal gasification apparatus according to claim 1, wherein said coal inlet in said hydrogenation gasifier chamber is preceded by a separating chamber connected thereto which receives the coal charge admixed with air and separates the coal from the air, and wherein a pressure lock having a rotating lock receptacle which is alternatingly connected to the space inside the separating chamber between said separating chamber and said coal inlet permits the separated coal to flow into the hydrogenation gasifier chamber.

* * * * *